US012221749B2

(12) United States Patent
Marusa et al.

(10) Patent No.: US 12,221,749 B2
(45) Date of Patent: Feb. 11, 2025

(54) ROLLER

(71) Applicant: Voith Patent GmbH, Heidenheim (DE)

(72) Inventors: Dominik Marusa, Heidenheim (DE); José Luiz Campos Souza, Heidenheim (DE); Thomas Martin, Langenau (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 18/082,958

(22) Filed: Dec. 16, 2022

(65) Prior Publication Data

US 2023/0117841 A1 Apr. 20, 2023

Related U.S. Application Data

(63) Continuation of application No. PCT/EP2021/063815, filed on May 25, 2021.

(30) Foreign Application Priority Data

Jun. 16, 2020 (DE) ..... 10 2020 115 802.5

(51) Int. Cl.
*D21F 3/08* (2006.01)
*D21F 3/04* (2006.01)

(52) U.S. Cl.
CPC . *D21F 3/08* (2013.01); *D21F 3/04* (2013.01)

(58) Field of Classification Search
CPC ..... D21F 3/08; D21F 3/04; D21F 1/40; D21F 7/00; D21G 1/0233; D21G 1/02; B65H 23/025
See application file for complete search history.

(56) References Cited

U.S. PATENT DOCUMENTS 4,566,162 A * 1/1986 Brands ..... B65H 23/0251 242/525.7
2016/0138222 A1 5/2016 Trani et al.

FOREIGN PATENT DOCUMENTS

DE 1 003 564 B 2/1957
DE 38 90 004 C1 8/1990
DE 198 57 123 C1 5/2000
EP 0663363 A1 * 7/1995 ..... 242/525.7

OTHER PUBLICATIONS

German Office Action dated Feb. 23, 2021 for German Patent Application No. 10 2020 115 802.5 (10 pages).
Notification of the Transmission of the International Search Report and Written Opinion of the International Search Authority or Declaration dated Sep. 14, 2021 for International Application No. PCT/EP2021/063815 (12 pages).

* cited by examiner

*Primary Examiner* — Jacob T Minskey
*Assistant Examiner* — Matthew M Eslami
(74) *Attorney, Agent, or Firm* — Taylor IP, P.C.

(57) ABSTRACT

The invention relates to a roller for producing a fibrous web, in particular a paper web including a rotationally symmetrical base body which is rotatable about a longitudinal axis and has a shell surface on which there are arranged at least two elastically deformable and/or deflectable ring-shaped lamellas which extend away from the shell surface in the radial direction and which surround the base body in the circumferential direction, wherein the lamellas are arranged at least in sections at an angle relative to a center plane of the roller aligned perpendicular to the longitudinal axis of the roller, thus forming an angle of inclination.

15 Claims, 3 Drawing Sheets

Fig.4
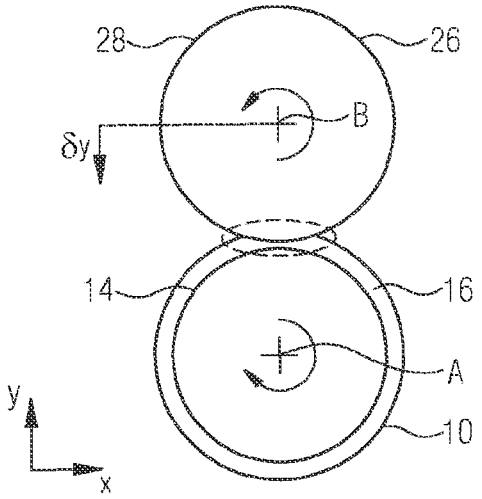
Fig. 5a
Fig. 5b
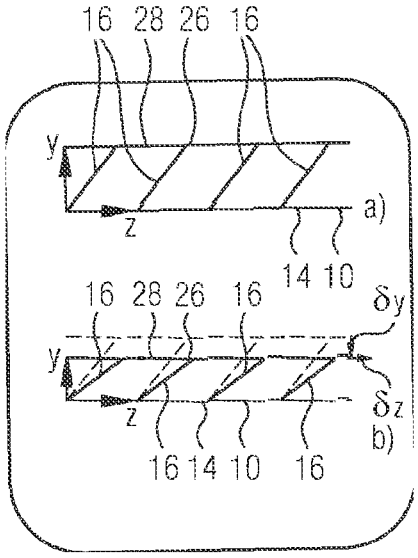
Fig.6
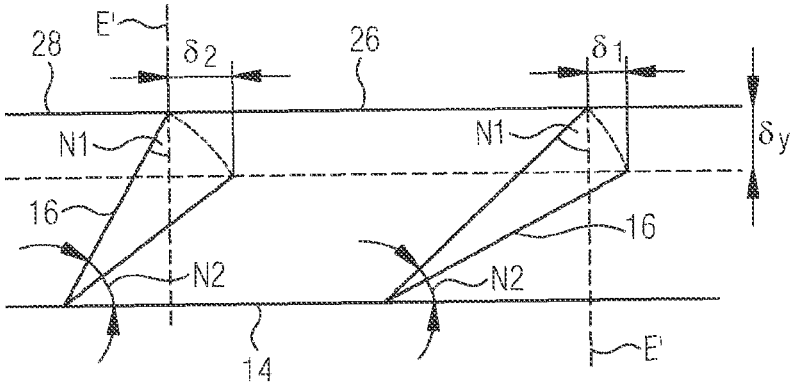

ROLLER

CROSS REFERENCE TO RELATED APPLICATIONS

This is a continuation of PCT application No. PCT/EP2021/063815, entitled "ROLLER", filed May 25, 2021, which is incorporated herein by reference.

BACKGROUND OF THE INVENTION

1. Field of the Invention

The current invention relates to a roller for producing a fibrous web, in particular a paper web, the roller having a rotationally symmetrical base body which is rotatable about a longitudinal axis and has a shell surface.

2. Description of the Related Art

In paper manufacturing, a fibrous web which is still moist, is conveyed in the direction of its longitudinal extension, whereby its moisture content is reduced in the process. The drying process results in a reduction of the space between the fibers of the fiber material, which ultimately results in a change in the volume of the fibrous web. In particular, the fibrous web experiences a change in length in the direction of its longitudinal extension and a change in width in a direction transverse to its longitudinal extension during drying, wherein the transverse shrinkage of the fibrous web is generally oriented at least approximately parallel to the longitudinal axis of the roll.

Whereas the change in length can be influenced in a targeted manner by a suitable arrangement of several rolls arranged in the conveying direction of the fibrous web in interaction with a belt that has a contractible surface layer—to prevent creping of the paper web (see i.e. DE 1 003 564 B)—the change in width or in the transverse shrinkage is rather a random consequence of the change in length and can only be controlled to a certain extent or not at all.

What is needed in the art is a roller that permits a change in width of the fibrous web.

SUMMARY OF THE INVENTION

The roller of the present invention includes a rotationally symmetrical base body which is rotatable about a longitudinal axis and has a shell surface on which there are arranged at least two elastically deformable and/or deflectable ring-shaped or spiral lamellas which extend away from the shell surface in the radial direction and which surround the base body in circumferential direction, wherein the lamellas are arranged at least in sections, diagonal relative to a center plane of the roller aligned vertically to the longitudinal axis of the roller, thus forming an angle of inclination.

The invention is based on the realization that, due to its elastically deformable and/or deflectable design and its diagonal orientation with respect to the center plane of the roll, a lamella can be deflected in radial direction perpendicular to the longitudinal axis of the roll as well as in axial direction parallel to the longitudinal axis of the roll by a force acting on the lamellas perpendicular to the shell surface of the roll. The degree of deflection of the lamellas depends thereby, among other factors, on the angle of inclination between the lamella and the center plane of the roll, on the strength of the force acting on the lamella and/or on the material properties of the lamella material. The length of the lamellas has influence over the force distribution, that is on the line force of the compression, which can be adjusted with the length. The fact is that the smaller the angle of inclination between the lamella and the center plane, and/or the longer a lamella and/or the greater the force acting on the lamella, the greater is the deflection of a lamella and the greater the deflection in the axial direction.

The invention is therefore based on the general concept of applying a force acting perpendicularly to the longitudinal axis of the roll to sections of a roll provided with such ring-shaped lamellas (i.e. by means of a mating roll) in such a way that, when viewed in the circumferential direction, the roll has deflected and undeflected lamella sections. A fibrous web running onto the undeflected lamella sections of the rotating roll undergoes compression or elongation in the axial direction in the region of the force application due to the deflection of the lamellas. The deflection of the lamellas acts on the fibrous material namely subject to friction. By a suitable selection of the angle of inclination of the lamella and/or the length of the inclined lamella and/or the force acting on the lamella, a targeted displacement of the fibrous web in the direction parallel to the longitudinal axis of the roll or in the direction transverse to the longitudinal extension of the fibrous web is achieved, whereby a change in width of the fibrous web can be adjusted in a controlled manner.

Targeted alternating compression of the fibrous web in longitudinal and transverse directions makes it possible to create an elastically stretchable fiber structure that, at the same time, is characterized by high mechanical strength. Such a fiber material can be used, for example, in paper bags for packaging cement.

The lamellas are preferably closed in the circumferential direction.

In another possible embodiment, the lamellas extend spirally on the roll provided with lamellas. The spirals can extend from the center plane of the roll to the roll edges. Or the spirals can also extend sectionally from the center plane of the roll to the roll edges. The spirals can be designed helically, either single-or multi-thread.

A force can for example be transferred to the lamellas by means of a mating roll by moving the mating roll and the roll equipped with lamellas towards each other in a radial direction and bringing the mating roll into contact with the lamellas. In such an arrangement of roll and mating roll, the longitudinal axis of the roll and a longitudinal axis of the mating roll are preferably aligned parallel to each other. A slight deviation from the parallelism of the longitudinal axes leads to a different deflection of the lamellas as viewed in their direction, which may be desired in individual cases.

The alignment of the lamellas at an angle of inclination N1, diagonal to the center plane of the roll, causes the formation of an angle of inclination N2 relative to the shell surface of the roll. In particular, at their radially inner ends the lamellas can have an angle of inclination deviating from 90° with respect to the shell surface of the roll. It is, however, fundamentally also conceivable that the lamellas extend with a first section at right angles away from the shell surface of the roller and have a diagonally angled second section adjoining the first section extending away at right angles.

For a targeted compression of the fibrous web in the direction transverse to its longitudinal extension, it is advantageous if the lamellas are respectively inclined in the direction of the center plane of the roll. However, the lamellas can also be inclined away from the center plane of the roll, in other words, inclined in the direction of edges limiting the roll in the axial direction, to allow targeted stretching of the fibrous web in the direction transverse to its longitudinal extension. In principle, however, the roll can also have lamellas inclined towards as well as away from the center plane of the roll in order to produce local transverse compression and transverse shrinkage of the fibrous web.

According to a preferred arrangement of the roll, a number of lamellas are arranged on the shell surface of the roll, originating from the edges in the direction of the center plane.

Symmetrical transverse compression or transverse stretching of the fibrous web can be achieved by arranging at least two lamellas symmetrically, in particular mirror-symmetrically, with respect to the center plane of the roll. In particular, a mirror-symmetrical arrangement of the lamellas makes it possible to achieve that the fibrous web is uniformly compressed or stretched in the direction transverse to its longitudinal extension.

Advantageously, a connection point at which a ring-shaped lamella is connected to the shell surface of the roll is aligned in a plane parallel to the center plane. The connection point of the lamella is thus essentially ring-shaped. However, it can also be positioned in a plane inclined at an angle to the center plane of the roll. In addition, it is also conceivable in principle that one or more lamellas surround the roll in a spiral manner.

To ensure that the fibrous web rests evenly on the lamellas as it is conveyed, the lamellas may have a substantially equal radial extension. In other words, all lamellas define a uniform circumference aligned parallel to the longitudinal axis of the roll. In principle, however, at least two lamellas can also have different outer circumferences. In particular, the circumferences of the lamellas originating from the respective edges of the roll can decrease in the direction of the center plane of the roll in order to achieve uniform transverse compression of the fibrous web. Accordingly, the diameters of the lamellas can increase from the center plane of the roll toward the respective edges of the roll to bring about transverse stretching of the fibrous web.

According to an advantageous embodiment of the roll, the angle of inclination of the lamellas can be varied in axial direction of the roll. In many cases, an axially varying transverse compression of the fibrous web is to be achieved, whereby this should often be as small as possible or even 0 in the center of the roll. It is then advantageous if the angle of inclination N1 of the lamellas increases from the edge of the roll towards the center plane, preferably continuously (N2 then decreases). In contrast, it is advantageous for transverse stretching of the fibrous web if the angle of inclination of the lamellas decreases from the center plane of the roll towards its edge, in particular it decreases continuously.

For transverse compression of the fibrous web, the distance between two adjacent connection points of the lamellas with the shell surface can decrease in the direction towards the center plane of the roll. If, in contrast, the fibrous web is to undergo transverse stretching, it is advantageous if a distance between two adjacent connection points of the lamellas with the shell surface increases in the direction towards the center plane of the roll.

According to another advantageous embodiment of a roll for producing a fibrous web compressed in the transverse direction, a diameter of the roll may change in the axial direction. In addition or alternatively, an intermediate body can be arranged between the shell surface of the roll and the lamellas, the diameter of which changes in the axial direction of the roll. The diameter of the roll or the diameter of the intermediate body increases preferably from the respective edges of the roll towards the center plane of the roll.

With a roll whose diameter varies in the axial direction or which has an intermediate body with a diameter that varies in the axial direction, it is advantageous if the lamellas each have the same radial outer extension. As a result, the distances between the respective connection point of a lamella with the shell surface of the roll or with the intermediate body and an outer edge of the lamella decrease or increase in the direction of the center plane of the roll. In other words, for example, with a roll diameter increasing towards the center of the roll, a lamella located further away from the center plane of the roll is longer than a lamella located closer to the center plane of the roll. Thus, for a roll with lamellas having the same angles of inclination, similar to a roll with lamellas having different angles of inclination, it is achieved that the longer lamella is deflected more strongly in the axial direction than a shorter lamella when radial force is applied, whereby a comparable effect can be achieved in the change in width of the fibrous web. It is understood that the two aforementioned approaches can also be combined.

The intermediate body can be in the shape of a double cone, wherein the respective outside diameter of the two cones increases, for example, in the direction of the center plane of the roll. It is however also conceivable that the intermediate body is convexly curved, with a diameter of the curved intermediate body being largest in the center plane. Basically, a shell surface of the intermediate body can be randomly configured in order to generate locally different stretching and/or compression. The shell surface of the intermediate body is preferably rotationally symmetrical.

For especially simple and easy manufacturing, the intermediate body and the lamellas can consist of the same material. It is however also conceivable to manufacture the intermediate body and the lamellas from different materials to enable a variable design of the intermediate body and lamellas.

It is understood that a diameter of the roll may decrease towards the center plane (in sections) and/or that an intermediate body may be arranged between the shell surface of the roll and the lamellas, the diameter of which decreases (in sections) towards the center plane of the roll, in order to stretch a fibrous web in its transverse direction (locally).

In particular (but not exclusively) in embodiments of the roll according to the invention with a longitudinally varying diameter of the shell surface, the distances between adjacent connection points of the lamellas with the shell surface can be substantially equal in the axial direction. The same applies analogously to embodiments with a corresponding intermediate body.

For particularly favorable deflection of the lamellas, the lamellas can be manufactured of an elastic and/or compression-resistant material, in particular plastic or rubber. Preferably, all lamellas are made of the same material. However, it is also conceivable that the lamellas manufactured of different materials.

Moreover, the lamellas can also be manufactured of a rigid material. In this case they would have to be attached to the shell surface of the roller or to the intermediate body by means of a joint pretensioned against a deflection direction and/or by means of another type of elastic connection.

For easy retrofitting of existing rolls or simple manufacture of a roll, the lamellas can be arranged on a roll cover which is fastened in a rotationally fixed manner on the shell surface of the roll. The roll cover and the lamellas are manufactured preferable of the same material, so that the roll cover and the lamellas can be manufactured quickly and cost-effectively. In order to facilitate flexibility in the design of the roll cover, the roll cover and the lamellas can be manufactured from different materials.

The roll cover provided with the lamellas can, for example, be mounted or shrunk onto the roll. However, it is also conceivable to mold the roll cover onto the roll, for example by way of an injection molding process. The lamellas can accordingly also be attached to a roll without a roll cover.

In principle, the lamellas can each have free outer ends onto which the fibrous web runs. To increase the contact area of the fibrous web, and to transfer the forces compressing or stretching, the web more uniformly, radial outer ends of at least two adjacent lamellas can be connected with a membrane, in particular with an elastic membrane. The membrane preferably forms a contact surface for the fibrous web, at least in sections. In particular, the membrane forms a continuous contact surface for the fibrous web so that the membrane essentially completely spans the lamellas. The membrane can be textured to increase the friction of the contact surface and thus improve force transmission.

For ease of manufacture, the lamellas and the membrane are preferably made of the same material. However, it is also conceivable to manufacture the membrane and the lamellas from different materials.

The present invention further relates to a roll arrangement including a roller provided with lamellas according to one of the embodiments described above and a mating roll, wherein a distance between the rolls is variably adjustable. As already mentioned above, the roll that is equipped with the lamellas and the mating roll are movable towards each other in the direction perpendicular to their longitudinal axes, allowing the two rolls to be brought into contact with each other (in the operating condition, the web of material is located between the rolls). When the two rolls are in contact, the mating roll exerts a force on the lamellas of the roll, according to the present invention, causing the lamellas to deflect in the axial direction. The stronger the two rolls come into contact with one another, in other words, the smaller the distance between the longitudinal axes of the rolls that are in contact with one another, the greater their deflection for a given lamella design and consequently the greater the force acting in the axial direction of the roll to which the fiber material web is subjected.

For an especially efficient drying process, the mating roll can be heated, as a result of which the moisture evaporates more quickly. In addition or alternatively, the mating roll can have a shell surface provided with openings, in particular a porous shell surface, wherein the openings connect the shell surface of the mating roll with the interior of the mating roll. A fluid can be conducted from the interior of the roll through the openings, to its shell surface. This fluid can be heated to accelerate the drying process. Alternatively or in addition, the fluid can be used to form a fluid cushion or a thin fluid film on the shell surface of the mating roll so that the fibrous web barely adheres or, at best, does not adhere at all to the mating roll. The fluid can be a gas, in particular an inert gas such as nitrogen, or water vapor. Moreover it is also conceivable that steam can escape from the openings in order to keep the fibrous web supple during conveying.

To ensure that the fibrous web does not adhere to the mating roll, or does not adhere to it to any appreciable extent, a shell surface of the mating roll can have a lower coefficient of friction than the outer surface of the roll equipped with the lamellas. The mating roll thus does not counteract the compression and/or stretching of the fibrous web, or counters it only to a small extent. The mating roll can be coated with Teflon® or silicone to reduce friction in interaction with the fibrous web or can have a thin water film, which can be produced by spraying on steam or water.

In order to potentiate the transverse compression or transverse stretching of the fibrous web, at least two rolls provided with lamellas can be assigned to the mating roll, wherein the rolls equipped with the lamellas and the mating roll respectively form a nip for receiving the fibrous web.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 4 illustrates a cross-sectional view of a roll arrangement with a roller according to the present invention;

FIG. 5*a* shows details of the roller arrangement of FIG. 4, in a load-free condition;

FIG. 5*b* shows details of the roller arrangement of FIG. 4, in a loaded condition;

FIG. 6 illustrates, in a schematic manner, details of the roller arrangement of the roller of FIG. 1.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
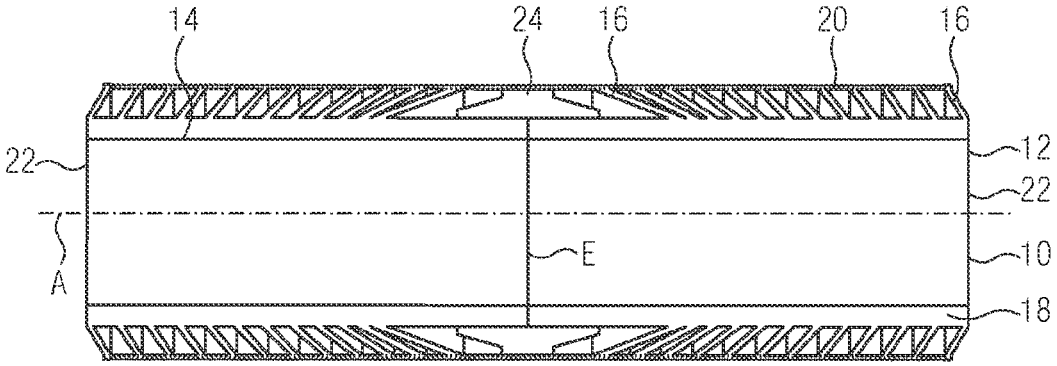
FIG. 1 illustrates a longitudinal sectional view of an embodiment of a roller of the present invention.
Figure 2:
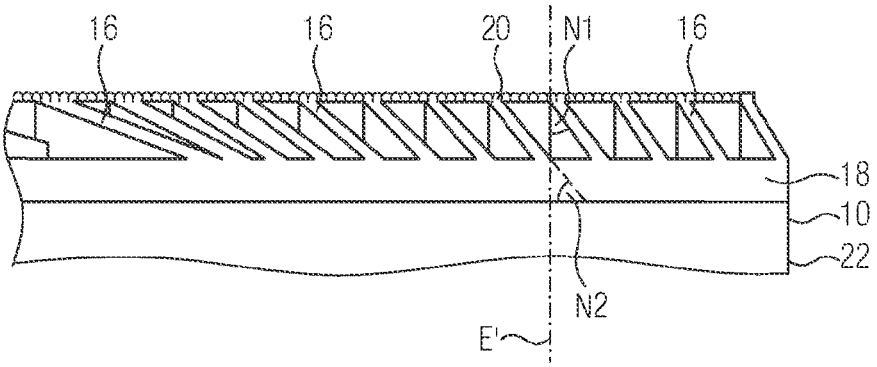
FIG. 2 show details of the roll shown in FIG. 1.
Figure 3:
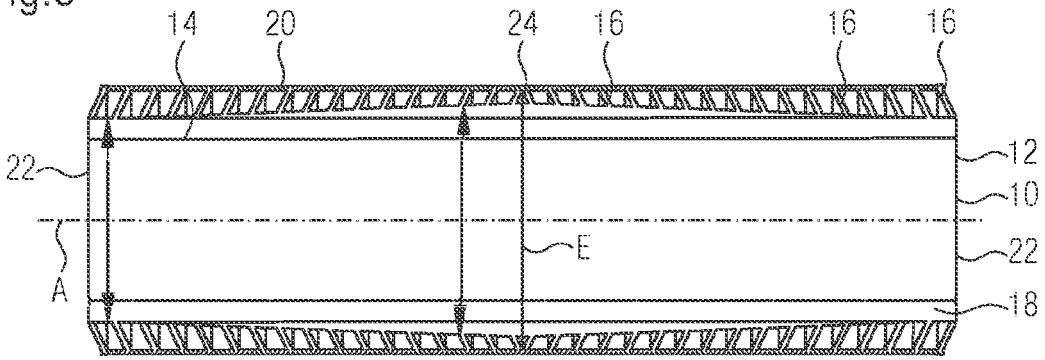
FIG. 3 illustrates a longitudinal sectional view of another embodiment of a roller of the present invention.
Figure 7:
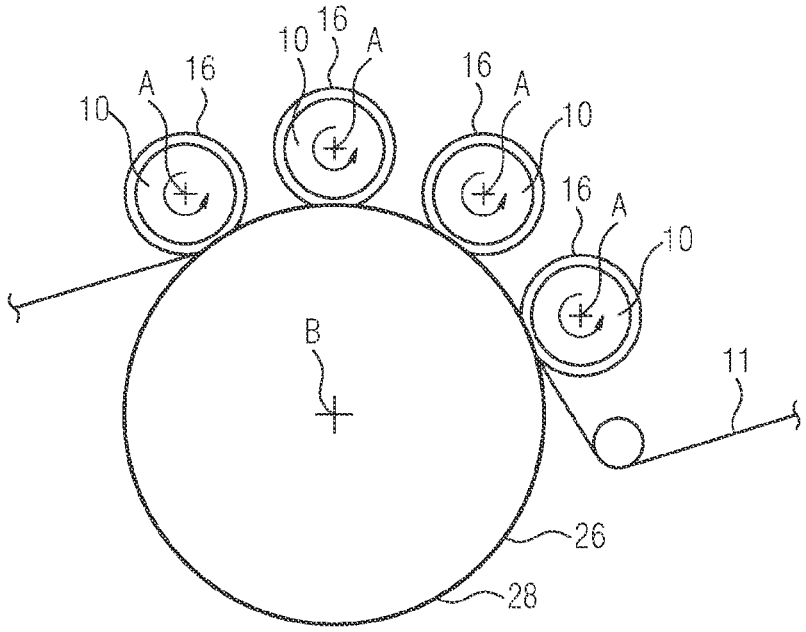
FIG. 7 shows a cross sectional view of an embodiment of a roller arrangement with several rolls according to the present invention.

Referring now to the drawings, and more particularly to FIG. 1, there is shown a roller 10 according to a first embodiment of the present invention, with a detail of which being shown in FIG. 2. A second embodiment of roller 10 is shown in FIG. 3. FIGS. 4 and 7 each show different embodiments of a roller arrangement with roller 10 shown in FIG. 1 or 3. FIGS. 5 and 6 serve to explain the principle of operation of rollers 10 shown in FIG. 1 or 3.

Rolls 10 shown in the figures serve to produce a fibrous web 11 (FIG. 7), in particular a paper web 11, in which compression or stretching in a direction transverse to the longitudinal extension of fibrous web 11 is to be adjusted in a controlled manner. In the following, the design examples are described in connection with a transverse compression of fibrous web 11.

Each roller 10, shown in the figures, can be rotated about its longitudinal axis A and each roller 10 has a rotationally symmetrical base body 12 with a shell surface 14. A number of elastically deformable and deflectable ring-shaped lamellas 16 are arranged on shell surface 14 and are made of an elastic and compression-resistant material. For example, lamellas 16 can be made of plastic or rubber material.

In the illustrated design examples, lamellasl6 are attached to an intermediate body 18 (for example, designed integrally with or molded to the latter) located between base body 12 and lamellas 16. Moreover, lamellas 16 surround base body 12 in its circumferential direction. In principle, lamellas 16 can also extend directly, that is without an intermediate body 18, at an angle directed away from shell surface 14 of base body 12 and be inclined toward a center plane E of roll 10.

Rolls 10 are designed not only rotationally symmetrical with respect to their respective longitudinal axes A, but also mirror symmetrical with respect to center plane E. In particular, lamellas 16 are arranged mirror-symmetrically with respect to center plane E as well as inclined mirror-symmetrically in the direction of center plane E of roller 10. It is understood that lamellas 16 may also be mirror-symmetrically inclined away from center plane E of roll 10 to facilitate transverse stretching of fibrous web 11. Asymmetrical lamella arrangements and/or designs are also implemented in order to be able to generate the desired compression and/or respectively stretching profile.

To ensure that fibrous web 11 runs evenly onto roller 10, all lamellas 16 have a substantially equal radial extension, whereby an outer diameter of an unloaded roller 10 is substantially constant.

As can be seen from the design examples, shown in FIGS. 1 to 3, radial outer ends of lamellas 16 are connected to a flexible membrane 20 to form a continuous contact surface for fibrous web 11. At this point, it should be noted that the conveying of fibrous web 11 is also possible without membrane 20, in other words, by direct placement of fibrous web 11 on lamellas 16. In principle, lamellas 16 connected to an elastic membrane 20 have a higher coefficient of friction than free-standing lamellas 16. To further increase the coefficient of friction, membrane 20 may also be textured.

Together with lamellas 16 and diaphragm 20, intermediate body 18 forms a roll cover which is secured in a rotationally fixed manner on shell surface 14 of roll 10. Lamellas 16 and intermediate body 18 as well as diaphragm 20 can thereby be made of the same material.

Lamellas 16, intermediate body 18 and/or diaphragm 20 can also be manufactured of different materials to ensure individual adaptability to the specific requirements.

Roll 10 according to a first embodiment is described below with reference to FIGS. 1 and 2.

Roller 10 according to the first embodiment includes a number of lamellas 16, whose angles N1 of inclination vary in an axial direction of roll 10. In FIG. 2, angle N1 is drawn with respect to a plane E, which is parallel to plane E.

Angles of inclination N1 between lamellas 16 and center plane E increase continuously from edges 22 limiting roller 10 in the axial direction towards center plane E. Such an alignment of lamellas 16 results in angles N2 between lamellas 16 and shell surface 14 decreasing continuously in the direction towards center plane E. This ensures that, when a force acting perpendicularly to longitudinal axis A of roll 10 is applied, a lamella 16 positioned in a more upright manner relative to shell surface 14 is deflected more strongly in a direction parallel to longitudinal axis A of roll 10 than a lamella 16 inclined more flatly to shell surface 14, as will be explained in more detail below (FIG. 6). With the reference system applied in FIGS. 4 to 6, this means that when a force acting in the radial direction of roller 10 (=y-direction) is applied, lamella 16, shown on the left-hand side, which is inclined in a more upright manner relative to shell surface 14, is deflected more strongly in a direction parallel to longitudinal axis A of roller 10 than lamella 16 shown on the right-hand side, which is inclined more flatly relative to shell surface 14, as will be explained in more detail below.

The decrease in angle N2 between lamellas 16 and shell surface 14 is accompanied by a gradual decrease in the distances between the connecting points of lamellas 16 with intermediate body 18 or respectively shell surface 14 of roll 10 in the direction of center plane E.

It can moreover be seen from FIGS. 1 and 2 that an outer circumference of intermediate body 18 is oriented, at least approximately, parallel to circumferential surface 14 of roller 10, wherein shell surface 14 coaxially surrounds longitudinal axis A of roller 10. Extending from intermediate body 18 is a compact but elastic support section 24, which mirror-symmetrically surrounds center plane E of roller 10 and against which fiber material web 11 rests without undergoing any appreciable transverse compression. This means that fibrous web 11 is compressed little or not at all in a direction transverse to the longitudinal extension of fibrous web 11. The compression of web 11 thus decreases inwards from edges 22 of roll 10.

In the second embodiment of roller 10, shown in FIG. 3, the distances between adjacent connecting points of lamellas 16, viewed in axial direction, are essentially the same. This also applies to angles of inclination N1. In order that a lamella 16, which is spaced further from center plane E of roll 10, and which is longer, and is thus more strongly deflected in the direction parallel to longitudinal axis A as a result of a force acting in the direction perpendicular to longitudinal axis A of roll 10 than a shorter lamella 16 arranged closer to center plane E, an intermediate body 18 is formed between lamellas 16 and base body 12, the diameter of which increases in the direction of center plane E of roll 10. Basically, if an intermediate body of constant thickness is used, a diameter of roll 10 could also increase continuously towards central plane E to achieve the same technical effect. At the maximum diameter of intermediate body 18 or roller 10, intermediate body 18 or roller 10 forms a support section 24 which has a comparable technical effect to support section 24 of roller 10 according to the first embodiment. The innermost lamellas 16 of the two roll halves, which are inclined towards each other, have a stabilizing effect so that here only small or negligible transverse forces are generated which act on web 11.

FIGS. 4 and 7 respectively show a roller arrangement that include both a roller 10, provided with lamellas 16, and a mating roller 26 rotatable about a longitudinal axis B. Roll 10 and mating roll 26 can be moved relative to each other in a direction in the x-y plane by the moving of longitudinal axes A, B of rolls 10, 26 in order to variably adjust or reduce a distance between rolls 10, 26. Rolls 10, 26 of the roll arrangement can be moved towards each other to such an extent that mating roll 26 exerts a force on lamellas 16 of roll 10 by way of web 11 which is conveyed between rolls 10, 26, causing lamellas 16 to deflect radially inwards.

It can be seen from FIGS. 4 and 7 that longitudinal axis A of roller 10 and longitudinal axis B of roller 26 are aligned at least approximately parallel to each other.

A shell surface 28 of mating roll 26 has a lower coefficient of friction than the outer surface of roll 10 formed by membrane 20. By minimizing friction between web 11 and shell surface 28, the compression/stretching of web 11 produced by roll 10 is efficiently implemented. To further reduce the coefficient of friction, mating roll 26 may have a shell surface 28 that is provided with openings not shown in the drawings. Through these openings, a fluid can leak from the interior of mating roll 26 to shell surface 28 of mating roll 26 to form a fluid film on shell surface 28 of mating roll 26. Moreover, a heated gas may escape through the openings to accelerate the drying process of fibrous web 11. Further-more, it is also conceivable that (water) steam escapes from the openings in order to keep fibrous web 11 supple while being conveyed.

To reinforce the transverse compression of fibrous web 11, at least two rolls 10 provided with lamellas 16 may be assigned to mating roll 26, wherein rolls 10 and mating roll 26 respectively form a nip for receiving fibrous web 11. In the illustrated design example of FIG. 7, four rolls 10 are assigned to mating roll 26.

In the following, the mode of operation of lamellas 16 of rollers 10 is explained again with reference to FIGS. 4 to 6.

In the area of a nip (see dashed oval in FIG. 4), mating roll 28 causes compression (δy) in the y-direction of the layer formed by lamellas 16 and membrane 20. This causes lamellas 16 to tilt, wherein their radially outer end is being displaced (δz) in the z-direction (parallel to axis A). From the geometric considerations of FIG. 6, it can be gathered that the offset δz is a function of the angle of inclination N1 or N2 in an unloaded state of lamellas 16: the smaller N1, the greater the offset δz for a given compression δy. A section of web 11 resting on left-hand lamella 16 in FIG. 4 is pulled more to the right than a section of web 11 resting on right-hand lamella 16. The reverse is true for N2. A Membrane 20 (not shown here) can be used to apply a force acting in the y-direction to web 11 over an area instead of applying the force at a single point.

In other words, when rolls 10, 26 are in operation, fibrous web 11 first runs onto the undeflected lamellas 16 and is then conveyed into the nip or contact area between rolls 10, 26. In the contact area, lamellas 16 experience a deflection due to the force exerted by mating roll 26, whereby lamellas 16, figuratively speaking, are "tilted" inwards and thereby pull the web material lying on them with their radially outer ends from the edge regions, in the axial direction, towards center plane E. Fibrous web 11 thus follows the deflection of lamellas 16 or (if present) of membrane 20 in the axial direction. This results in fibrous web 11 being compressed transversely to its longitudinal extension. It is understood that when lamellas 16 are inclined outwardly, i.e. away from center plane E, web 11 undergoes elongation in the direction transverse to its longitudinal extension.

By varying the lamellas and/or intermediate body design in the axial direction, a transverse compression and/or transverse elongation of fibrous web 11 can thus be set in a targeted manner. Complex compression and/or elongation profiles can also be generated. The transverse compression or elongation can be increased by several rolls 10 provided with lamellas 16 (FIG. 7).

The concept according to the invention can also be implemented on high-performance lines with web speeds of higher than 1000 m/min. For example, a transverse shrinkage of 10 to 30% is achieved at basis weights of 70 to 200 $g/m^2$ and paper moisture contents of 55 to 90%.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

10 Roll
11 Fibrous web
12 base body
14 shell surface
16 lamellas
16 intermediate body
20 membrane
22 edge
24 support section
26 mating roll
28 shell surface
A longitudinal axis
B longitudinal axis
E center plane
E' plane parallel to T
N1, N2 angle of inclination

What is claimed is:

1. A roller for producing a fibrous web, the roller comprising:

a rotationally symmetrical base body which is rotatable about a longitudinal axis; and a shell surface on which there are arranged at least two elastically deformable and/or deflectable ring-shaped or spiral lamellas which extend away from the shell surface in a radial direction, the lamellas surround the base body in a circumferential direction, wherein the lamellas are arranged at least in sections at an angle diagonally relative to a center plane of the roller, the center plane being aligned perpendicular to the longitudinal axis of the roller, thus forming the angle in the form of an angle of inclination, the lamellas being inclined toward the center plane of the roller and are arranged to transversely compress the fibrous web, wherein the angle of inclination of the lamellas varies in an axial direction of the roller, wherein the angle of inclination of the lamellas increases from an edge of the roller towards the center plane, wherein a distance between two adjacent connection points of the lamellas with the shell surface increases in the axial direction towards the center plane of the roller.

2. The roller according to claim 1, wherein the at least two lamellas are arranged in a mirror-symmetrical manner with respect to the center plane of the roller.

3. The roller according to claim 1, wherein a radial extension of the lamellas is substantially equal.

4. The roller according to claim 1, wherein the angle of inclination increases continuously towards the center plane.

5. The roller according to claim 1, wherein a diameter of the roller changes in a direction toward the center plane of the roller increases and/or an intermediate body is arranged between the shell surface of the roller and the lamellas having a diameter of which increases in the direction of the center plane of the roller.

6. The roller according to claim 5, wherein distances between adjacent connection points of the lamellas with the shell surface is substantially equal in the axial direction.

7. The roller according to claim 1, wherein the lamellas are manufactured of an elastic and/or compression-resistant material, the material being plastic or rubber.

8. The roller according to claim 1, wherein the lamellas are arranged on a roll cover which is fastened in a rotationally fixed manner on the shell surface of the roller.

9. The roller according to claim 8, wherein the roll cover and the lamellas are manufactured of the same material.

10. The roller according to claim 8, wherein radial outer ends of at least two adjacent lamellas are connected with an elastic membrane or that membrane at least in sections forms a continuous contact surface.

11. A roller arrangement, comprising:

a roller according to claim 1; and a mating roller, wherein a distance between the rollers is variably adjustable.

12. The roller arrangement according to claim 11, wherein the mating roll is heated and/or has a shell surface with openings, in the form of a porous shell surface, wherein the openings connect the shell surface of the mating roll with an interior of the mating roll.

13. The roller arrangement according to claim 12, wherein the shell surface of the mating roll has a lower coefficient of friction than the outer surface of the roller.

14. A roller arrangement, comprising:

a first and a second roller each including:

a rotationally symmetrical base body which is rotatable about a longitudinal axis; and a shell surface on which there are arranged at least two elastically deformable and/or deflectable ring-shaped or spiral lamellas which extend away from the shell surface in a radial direction, the lamellas surround the base body in a circumferential direction, wherein the lamellas are arranged at least in sections at an angle diagonally relative to a center plane of the roller, the center plane being aligned perpendicular to the longitudinal axis of the roller, thus forming the angle in the form of an angle of inclination, the lamellas being inclined toward the center plane of the roller to transversely compress a fibrous web; and a mating roll, wherein a distance between each of the rollers and the mating roll is variably adjustable, wherein the first and second rollers are assigned to the mating roll which, together form a nip to receive the fibrous web.

15. A roller for producing a fibrous web, the roller comprising:

a rotationally symmetrical base body which is rotatable about a longitudinal axis; and a shell surface on which there are arranged at least two elastically deformable and/or deflectable ring-shaped or spiral lamellas which extend away from the shell surface in a radial direction, the lamellas surround the base body in a circumferential direction, wherein the lamellas are arranged at least in sections at an angle diagonally relative to a center plane of the roller, the center plane being aligned perpendicular to the longitudinal axis of the roller, thus forming the angle in the form of an angle of inclination, the lamellas being inclined toward the center plane of the roller and are arranged to transversely compress the fibrous web, wherein the angle of inclination of the lamellas varies in an axial direction of the roller, wherein the angle of inclination of each subsequent lamella of the plurality of lamellas increases from a previous lamella in a direction from an edge of the roller to the center plane.

* * * * *